US006648057B2

(12) United States Patent
Dworog et al.

(10) Patent No.: US 6,648,057 B2
(45) Date of Patent: Nov. 18, 2003

(54) APPARATUS FOR MANUFACTURING SEMI-FINISHED PRODUCTS AND MOLDED ARTICLES OF A METALLIC MATERIAL

(75) Inventors: Andreas Dworog, Krefeld (DE); Erwin Bürkle, Bichl (DE); Hans Wobbe, Herrsching (DE); Rainer Zimmet, Neckarwestheim (DE); Jochen Zwiesele, München (DE)

(73) Assignee: Krauss-Maffei Kunststofftechnik GmbH, München (DE)

( * ) Notice: Subject to any disclaimer, the term of this patent is extended or adjusted under 35 U.S.C. 154(b) by 0 days.

(21) Appl. No.: 10/351,803

(22) Filed: Jan. 27, 2003

(65) Prior Publication Data

US 2003/0111205 A1 Jun. 19, 2003

Related U.S. Application Data

(62) Division of application No. 09/931,289, filed on Aug. 16, 2001, now Pat. No. 6,546,991, which is a continuation of application No. PCT/EP00/01417, filed on Feb. 21, 2000.

(30) Foreign Application Priority Data

Feb. 21, 2000 (DE) ..... 199 07 118

(51) Int. Cl.[7] ..... B22D 17/04

(52) U.S. Cl. ..... 164/312; 164/418; 425/147; 425/204

(58) Field of Search ..... 164/312, 418, 164/113, 900, 459; 425/147, 204

(56) References Cited

U.S. PATENT DOCUMENTS 4,047,705 A * 9/1977 Hanslik ..... 259/192
4,486,304 A * 12/1984 Neuman et al. ..... 210/107
5,409,366 A * 4/1995 Vincent ..... 425/204
5,680,894 A * 10/1997 Kilbert ..... 164/312
5,798,128 A * 8/1998 Dumazet et al. ..... 425/147
6,241,001 B1 * 6/2001 Kono ..... 164/312
6,364,518 B1 * 4/2002 Gleich et al. ..... 366/86
6,546,991 B2 * 4/2003 Dworog et al. ..... 164/113

FOREIGN PATENT DOCUMENTS

| | | |
|---|---|---|
| DE | 195 17 009 A | 11/1996 |
| DE | 195 48 524 | 10/1998 |
| EP | 0 080 787 | 12/1982 |
| EP | 0 743 160 A | 11/1996 |
| EP | 0 761 344 A | 3/1997 |
| EP | 0 867 246 | 3/1998 |
| EP | 0 835 734 A | 4/1998 |
| JP | 07 108575 A | 4/1995 |
| WO | WO 86 06321 A | 11/1986 |

OTHER PUBLICATIONS

"Announcement" Modern Plastics Int., vol. 23, No. 10, Oct. 23, 1993, p. 109, (No date avail).

* cited by examiner

*Primary Examiner*—Tom Dunn
*Assistant Examiner*—I.-H. Lin
(74) *Attorney, Agent, or Firm*—Henry M. Feiereisen

(57) ABSTRACT

An apparatus for manufacturing semi-finished products and molded articles of metallic materials includes an extruder for producing a flow of the metals, with appliances being connected thereafter for shaping the semi-finished products and the molded articles. The extruder has a screw system consisting of two or more meshing screws. This design has an improved functionality and can produce components with reproducible quality.

16 Claims, 3 Drawing Sheets

APPARATUS FOR MANUFACTURING SEMI-FINISHED PRODUCTS AND MOLDED ARTICLES OF A METALLIC MATERIAL

CROSS-REFERENCE TO RELATED APPLICATIONS

This application is a division of prior filed application Ser. No. 09/931,289, filed Aug. 16, 2001 and now issued as U.S. Pat. No. 6,546,991, which in turn is a continuation of PCT Application No. PCT/EP00/01417, filed Feb. 21, 2000, which in turn claims the priority of German patent application DE 199 07 118.7 filed Feb. 19, 1999.

FIELD OF THE INVENTION

The invention relates to an apparatus for manufacturing semi-finished products and molded articles of metallic material incorporating an extruder for producing a metal flow and appliances connected thereafter for molding the semi-finished products and the molded articles.

BACKGROUND OF THE INVENTION

A device of this type for die-casting preforms is known from EP 0 080 787, wherein a metallic material having dendritic properties, a magnesium alloy for example, is converted into a thixotropic state in an extruder. In this state, the metallic material has a mud-like or pasty consistency and can be processed so as to form metallic molded articles in the molding appliances following the extruder.

From EP 0 080 787, it is known to use a die-casting unit connected after the extruder for the molding or shaping operations, or else to process this material directly in a conventional injection molding machine without previously processing the metallic material in an extruder. There however, processing in an injection molding machine is disregarded because of the superimposition of rotational and translational movements by the injection worm (reciprocating screw) and the increased problems of sealing arising thereby in comparison with the use of the extruder (merely rotational).

The process of converting the metallic material (e.g. the magnesium alloy) into a thixotropic mass in the extruder is effected, in the manner described in EP 0 080 787, by feeding the material in granular form into a pre-heated feed hopper, whereby the size of the granular particles is made such that they can be easily processed by the screw in the extruder. The heating of the granules is effected at a temperature which is close to or above the solidus temperature whereby the heating process may take place either prior to and/or in the extruder.

The metallic material is in any case subjected to further heating in the extruder by means of external heating devices that are effective via the screw cylinder, and also as a result of frictional heat (shear stress). Hereby, the heating process in the extruder is controlled in such a manner that the temperature of the metallic material will remain below its liquidus temperature.

Due to the maintenance of a temperature in the range between the solidus and the liquidus temperatures and also due to the shear stress, the effect achieved in the extruder is that the dendritic structures of the metallic material will be broken down and a solid-liquid metal alloy in a thixotropic state will emerge from the output of the extruder.

In this device for producing a solid-liquid thixotropic metal alloy which is known from EP 0 080 787, there is a feed channel in the form of a continuous helical channel between the flanks of the screw from the start of the screw up to the end thereof.

Basically, the underlying principle of the conveying process in an extruder is that the material being moved experiences friction against the cylinder walling of the extruder and glides over the so-called base of the screw. When processing metallic materials, the problem arising as a result of the high thermal conductivity is that there is a build up of a smelt film on the cylinder walling, said film being of very low viscosity and considerably reducing the friction between the material being moved and the cylinder walling thereby leading to a drastic reduction in the performance of the conveying process. Moreover, the mixing process also suffers to a considerable extent whereby a growing temperature gradient over the cross-section of the interior of the extrusion cylinder, which gradient increases from the exterior to the interior thereof, cannot be effectively dissipated.

As a consequence of these conditions, there arise inhomogeneities between the solid and liquid components and the stability of the conveying process becomes extremely unsatisfactory whilst the build up of pressure is highly erratic. Continuously altering process states thereby arise whereby the resultant non-reproducible quality of the components has to be accepted.

It is therefore desirable to improve the construction and functionality of an apparatus of the type mentioned in such a manner that reproducible component-qualities can always be produced.

SUMMARY OF THE INVENTION

According to one aspect of the invention, an extruder for producing a flow of metal and appliances connected thereafter for shaping the semi-finished products and the molded articles includes a screw system consisting of two or more meshing screws.

In the case of the apparatus in accordance with the invention, the processing of the metallic material, for example, starting from the granular state up to the thixotropic solid-liquid material or the liquid material states thereof, is effected in such a manner that, taken with reference to the axial length of the extruder, the processing steps will generally be consistent and the material will be continuously advanced. The negative consequences of fluctuations in temperature and the irregularities of viscosity inherent therein together with the proportional composition of the liquid material components are thereby reduced to a negligible amount.

It has been found that the previously described problem encountered in single screw extruders can be eliminated by means of an extruder including a screw system comprising two or more meshing screws, although the problems described above still have to be taken into account initially even with this type of extruder. Here however, there is a counteracting mechanism at work which, surprisingly, is of sufficient extent as to allow the material being conveyed to be transferred from one screw onto the adjacent meshing screw. It is evident thereby, that when processing metallic materials, an adequately large mixing and transportation effect is achieved which ensures continuous advancement of the metallic material being conveyed in addition to the dissipation of the temperature gradient. Stable feeding of fresh material into the inlet zone of the extruder has also been observed in addition to the increase in mixing performance.

This has a particularly positive effect when processing materials in granular or chip-like form since the bulk density thereof of typically approximately 0.5 to 0.8 g/cm$^3$ has to be doubled or brought up to the still higher densities of approximately 1.7 g/cm$^3$ or more of the solid-liquid stream of material. This is difficult if not impossible in the case of the reduced conveyor performance of an extruder.

Heating strips or heating devices functioning inductively are used conventionally for the purposes of introducing heat when processing metallic smelts.

However, inductive heating devices are very expensive. Classical heating strips are mounted around the periphery of the extruder cylinder engine and tend to become heavily oxidized at the high temperatures prevailing when processing metallic smelts, this leading to scaling of the cylinder surface and hence reducing thermal transfer between the heating body and the cylinder. Moreover, precautions have to be taken when using heating strips so as to retain them in continuous contact with the surface of the cylinder in order to achieve adequate thermal transfer.

Another disadvantage associated with heating strips is the large spacing between the heating strips mounted externally on the extruder cylinder and the smelt present in the interior of the cylinder in the face of the necessarily high heat flow densities and temperature gradients of up to 200° C. and more which occur in operation.

If the ratios involved even in the case of a single screw extruder are not particularly favorable, then the heat introduction ratio is still less favorable in the case of two and more screw extruders since the spacing between the outer cylinder surface and the inner walls thereof is inevitably increased here due to the geometrical considerations.

In accordance with the invention, so-called heating cartridges, which comprise resistance heating elements arranged in a usually cylindrical housing, are of assistance here.

The heating cartridges can be arranged in transverse bores in the cover of the extruder cylinder very close to the inner walling of the cylinder, for example, above and below the double cylinder chamber in the two screw extruder. The transverse bores themselves may be hermetically sealed using an airtight and heat resistant material so that they will be protected from scaling.

Substantially greater heat flow densities can be obtained due to the very small spacing between the heating cartridges and the inner walling of the extruder cylinder. Moreover, the outer surface of the extruder cylinder can be insulated to a still greater extent against loss of heat by the use of the heating cartridges arranged in the cylinder walls.

The extruder together with the heating cartridges mounted therein can be produced in such a manner that the tie rods thereof are arranged outside the insulating means and thus located in a considerably cooler region. Substantially more economical materials can thereby be used therefor.

The driving arrangement for the extruder screws as well as the driving arrangement for the die-casting pistons is often implemented by means of hydraulic systems.

However, there is a certain safety risk in regard to the combustibility of the hydraulic fluids due to the high temperatures occurring when processing metal smelts.

Accordingly, electrical drives are preferably used for the screws, but so too, electrical drives could also be used for driving the die-casting pistons rather than a hydraulic system.

Granular materials having dissimilar shaped grains can now be processed by means of the method in accordance with the invention and thus, in toto, there is a considerably broader spectrum of starting materials available, whereby one can resort to more economical starting materials.

Furthermore, due to the continuous conveying process, the band width of the period in which the materials being conveyed will remain in the extruder is reduced, this being shown by a uniform grain size in the globulites in the structure of the finished preforms or semi-finished products.

The previously described effects are immediately apparent if the screws rotate in the same sense. The positive effect is strengthened by using closely engaging screws.

Alternatively, screws rotating in the opposite sense could also be used, whereby an enforced advancement process would then be implemented here.

The extruder may be followed by one or more die-casting moulds which are adapted to be loaded with metallic material on a continuous or discontinuous basis via multi-way switches and heated channels.

A reduction of the production cycle can thereby be implemented, or larger components, especially thin-walled large surface area components can be manufactured, whereby a plurality of die-casting units can be connected to a molding cavity.

Due to the controllable processing states that are always running uniformly in the extruder, it is particularly suited for side feeding of differing metallic and non-metallic materials, especially of reinforcing components such as fibers for example.

Side feeding may be effected by means of a volumetric or gravimetric metering system.

Side feeding of the differing materials is effected at those functional and temperature zones which are appropriate for the respective materials. Pure metals e.g. Li, Mg, Ca, Al, Si, Zn, Mn, rare earth metals and the like can thus be compounded to form metal alloys, and, by the same token, pre-existing alloys such as e.g. AlZn can be supplied to the extruder in accordance with the invention. Moreover, non-metallic materials such as e.g. reinforcing materials, fillers, seeding agents, catalysts and the like can also be worked into the solid-liquid or liquid metal flow in this manner, whereby the extruder in accordance with the invention fulfils the function of a machine for manufacturing alloys or compound materials.

In addition, pre-prepared and especially liquid materials can also be supplied via side feeding by the previously proposed aggregates such as the extruders for example.

Basically, components of constant quality are thereby producible, whereby they may consist of pure metal, metal alloys or of non-metallic materials mixed homogeneously with the metal or the metal alloys.

The appliances connected to the output of the extruder for molding the semi-finished products and preforms may be selected from a large range. To mention just some of the most important:

Die-casting aggregates.

Continuous molding and extrusion aggregates.

In the case of die-casting aggregates, one should mention those die-casting aggregates that are equipped with a separate piston/cylinder unit such as are known from EP 0 080 787 for example.

Hereby, one should differentiate between the various types:

piston/cylinder aggregates which are filled at the front face of the piston, whereby the piston is in the withdrawn position at the beginning of the filling operation in the case of one variant and the filling operation takes place either directly in front of the piston or at a position displaced therefrom in the direction towards the cylinder opening; in an alternative variant, filling takes place at the cylinder opening and the piston is driven back or forced back during the filling operation, and in a further variant, the filling operation takes place in the cylinder chamber in front of the piston in the cylinder outlet channel and the piston is moved from the forward dead position by the inflowing metallic material into the withdrawn position.

In another embodiment, a so-called differential piston subdivides the cylinder chamber of the die-casting cylinder into a feed chamber connected via a heated channel to the extruder and an injection chamber connected to the molding cavity. A fluidic connection is created between the feed chamber and the injection chamber, said fluidic connection incorporating a return-flow blocking device or a non-return valve which counteracts any return flow of metallic material from the injection chamber into the feed chamber.

The differential piston has a greater area of piston surface at the injection chamber side thereof and a smaller, usually annular piston surface at the feed chamber side thereof.

The thixotropic metallic material that it is fed by the extruder into the feed chamber at a pressure of e.g. less than 120 bar is brought up to the injection pressure of e.g. 500 bar or more, especially 1000–2000 bar, by means of the differential piston, whereby losses due to leakage play no part since the leaked quantities entering the feed chamber from the injection chamber will be fed back into the injection chamber during the next injection phase.

Another advantage of the differential piston is that the proportionately low pressure in the material fed into the die-casting cylinder automatically returns the differential piston due to the pressure difference set up between the larger piston surface and the smaller annular piston surface, whereby the insertion of multi-way valves between the extruder and the die-casting cylinder is thereby redundant. If necessary, this process can be assisted hydraulically. Finally, there also arises the advantage that the flow of metallic material produced by the extruder is always advanced in just one direction towards the injection process in the molding cavity, this being particularly appropriate when processing materials into which long reinforcing fibers (e.g. carbon fibers) are to be worked and said fibers enter the extruder by side feeding.

Furthermore, the invention relates to a method of die-casting, continuous casting or extrusion molding metallic materials using an extruder followed by units for shaping semi-finished products and preforms, especially of the type described above. The use of an extruder incorporating a screw system comprising two or more meshing screws permits the metallic material to be conveyed in the direction of extrusion in a controlled manner. This also applies especially for materials in the solid-liquid thixotropic state as well as for materials in the liquid state.

Discontinuities occurring when processing the metallic material are avoided by virtue of the controlled advancement process or the enforced advancement process, this making a considerable contribution to improved consistency in the component quality of the metallic components produced in the die-casting process.

The processing of the metallic material in accordance with the invention and the controlled or enforced conveyance thereof in the extruder now permits, in a particularly simple and defined manner, the side feeding of further components, for example alloying components when manufacturing alloys, reinforcing components when manufacturing metallic compound materials, or other additional materials for modifying the metallic materials.

In particular, the controlled or enforced conveyance in the extruder ensures greater homogeneity of the metallic material produced.

In a series of cases, it is also useful to work at or above the liquidus temperature, especially in a range of approximately 5° C. to 10° C. above liquidus.

Working above liquidus is to be recommended in some cases of application since the mixing process is further assisted here and this improves especially the wetting of the added fibers.

An embodiment of the apparatus in accordance with the invention will now be described with reference to the drawing.

DETAILED DESCRIPTION OF PREFERRED EMBODIMENTS

Figure 1:
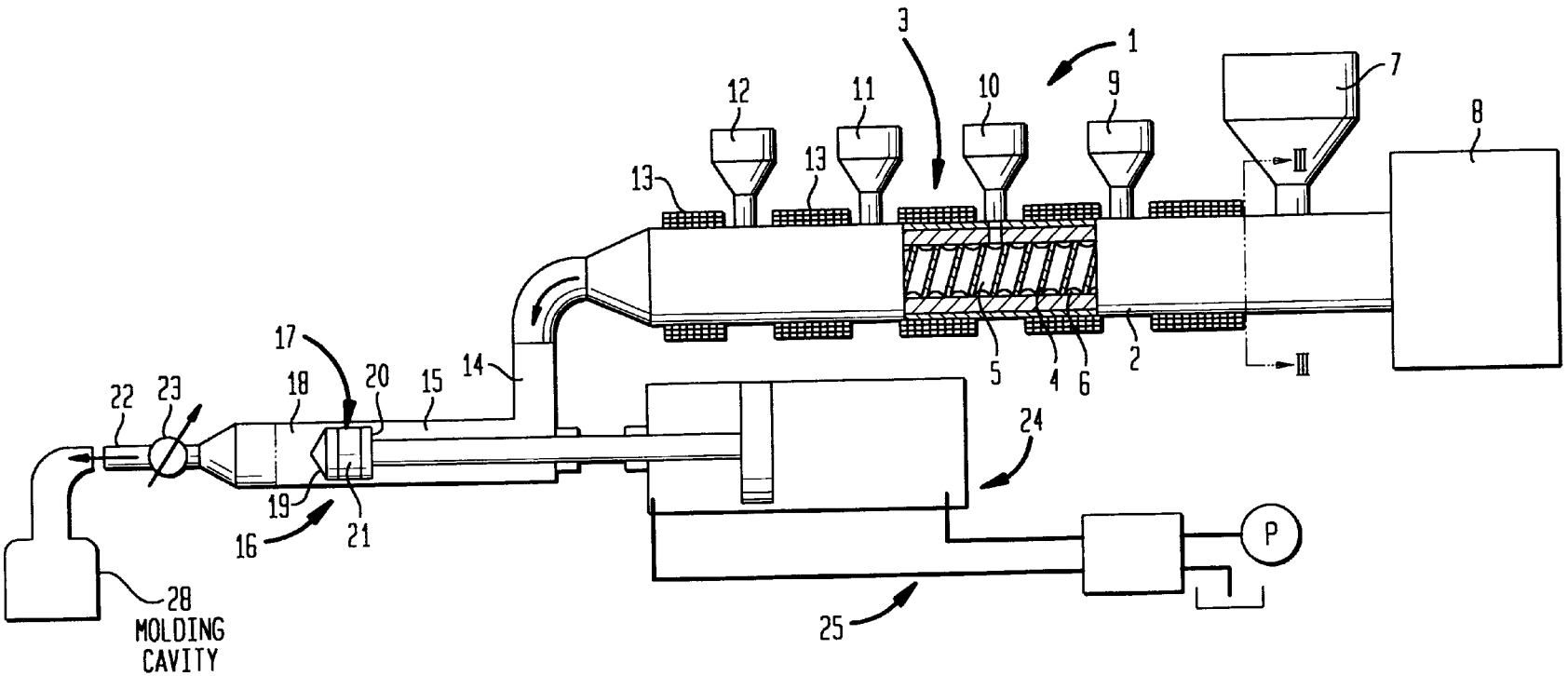
FIG. 1 shows a schematic partially broken away illustration of a double screw extruder in accordance with the invention.

FIG. 1 shows schematically an extruder 1 of the double screw extruder type, wherein two screws are mounted in the extruder cylinder 2 thereof, only the front screw 3 being visible in the broken away region illustrated. The profile of the screw 3 engages in the profile of the neighboring screw located behind it. Thereby, the head face 4 of the screw drive threads of the one screw 3 abuts the core face 5 of the (not visible) neighboring screw. The spacing of the head diameter $K_1$ of the one screw relative to the core diameter $K_2$ of the neighboring screw as well as the spacing of the flanks of the screw relative to one another should be selected such that a desired level of shear stress can be produced in the case of a metallic material having dendritic properties that is to be processed on the one hand, but whereby, on the other hand, the liquid phase of the metallic material cannot flow in uncontrolled manner through the gap between the screw flanks, the head surfaces 4 and the core surfaces 5 or between the head surfaces 4 and the inner walling 6 of the extruder cylinder 2 due to its much lower viscosity. In the case where the screws are driven in opposite senses, the meshing screws form chambers that are progressively closed towards the front whereby the material will be compulsorily transported therein.

The dendritic structures of the solid phase are converted into globulite particles by virtue of the shearing process on the one hand, whereby frictional heat is released on the other.

The driving assembly 8 for the screws 3 is located adjacent to the region of the feed hopper 7 used for filling the extruder 1 with metallic material, for example, in granular, chip-like or powder form. Furthermore thermal decoupling means (not shown) are arranged between the driving assembly and the cylinder and screws.

Following the feed hopper 7, there are a series of feed devices 9 to 12 via which additional materials can be fed into the extruder 1 at those processing and temperature stages which are appropriate to the material being added. Thermal energy is introduced into the extruder 1 from the exterior via heating collars 13 each of which is illustrated in half section.

The feed devices 9 to 12 can be selected from amongst feed hoppers, metering screws, filler devices, belt or roving feeders, extruders (inclusive of the double screw extruder in accordance with the invention) or injection aggregates for fluids.

An inert gas forming a protective gas is preferably applied to the feed devices 9 to 12.

It should be emphasized at this point, that the screw 3 is illustrated only schematically and may have different configurations along its length. In particular, the corresponding screw sections opposite the feed devices 9 to 12 are matched to the respective function of the screw.

The solid-liquid metallic thixotropic material produced in the extruder 1, which may be mixed with the most varied of additional materials, is guided via a first heated channel 14 into the feed chamber 15 of a die-casting cylinder 16. A differential piston 17 is disposed reversibly in the die-casting cylinder 16, said piston subdividing the cylinder chamber of the cylinder 16 into the feed chamber 15 and the injection chamber 18. The piston surface 19 bounding the injection chamber 18 is larger than the annular piston surface 20 bounding the feed chamber 15. A means for preventing reverse flow in the form of a non-return valve 21 for example is located in the differential piston 17. The means for preventing reverse flow 21 blocks the fluidic connection in the form of a through passage (not shown) in the differential piston 17 from the injection chamber 18 to the feed chamber 15, whilst it opens said through passage in the reverse direction.

A second heated channel 22 leading to the molding cavity 28 is adjacent to the injection chamber 18, said second channel being adapted to be closed by an active controllable shut-off nozzle 23.

The differential piston 17 is displaceable in reversible manner in the injection piston 16 by means of a hydraulic piston cylinder unit 24 of a hydraulic system 25.

In operation, the thixotropic or even liquid metallic material, which is produced in the extruder 1 and which may be mixed with various additional materials, is guided via the first heated channel 14 into the feed chamber 15 and then reaches the injection chamber 18 via the through passage in the differential piston 17, the outlet of said injection chamber being blocked by the shut-off nozzle 23. Due to the surface ratio of the larger piston surface 19 relative to the smaller annular piston surface 20, the differential piston 17 is effectively a differential pressure piston arrangement and automatically moves back until the quantity of material required for the subsequent injection process has been loaded. The hydraulic piston-cylinder unit 24 is controlled during the filling process of the die-casting cylinder 16 in such a manner that the differential piston 17 can be pushed back in a controlled manner and will be stopped when the required quantity of filling material has been reached. The filling process takes place at the low-pressure level produced by the extruder 1 (e.g. 5 to 120 bar).

In the succeeding injection process, the differential piston 17 is pushed forward by the hydraulic piston cylinder unit 24, whereby the reverse flow blocking means 21 closes and the pressure in the injection chamber 18 increases to the injection pressure (e.g. 1500–2000 bar). The thixotropic or possibly liquid metallic material flows into the molding cavity via the opened shut-off valve 23 and the second heated channel 22. Leakage occurring at the high injection pressure plays no part because the leaked quantity can only enter the feed chamber 15 from where it can be returned to the injection chamber 18. Sealing of the feed chamber 15 relative to atmosphere or relative to a hydraulic chamber of the hydraulic piston-cylinder unit presents no problems due to the substantially lower level of pressure.

Only one die-casting cylinder 16 is illustrated in the drawing of FIG. 1 although two or more cylinders that are to be filled in parallel or alternately may be provided.

In this case, these cylinders may be supplied merely via the branches of a first heated channel. The arrangement of multi-way valves is not absolutely necessary thereby since the process of filling the die-casting cylinders is effected on each occasion by means of the control system for the appertaining hydraulic piston-cylinder unit.

Figure 2:
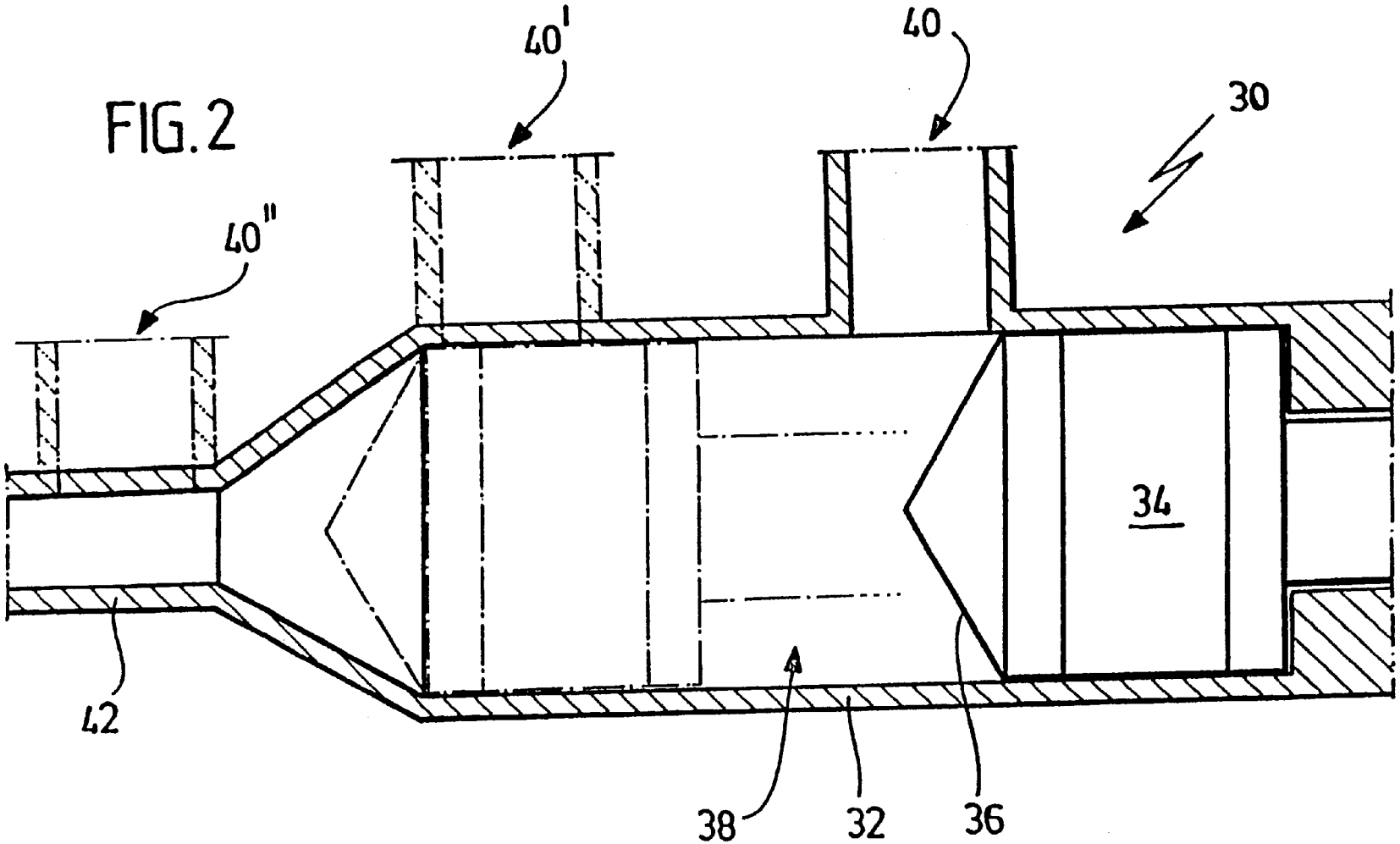
FIG. 2 shows a schematic illustration of differing embodiments of the die-casting aggregates following the extruder in FIG. 1.

FIG. 2 shows schematically a die-casting cylinder 30 forming an alternative to that shown in FIG. 1 and which may be used together with the double screw extruder 1 in accordance with the invention in the form of a component of a shaping appliance. The die-casting cylinder 30 comprises a hollow cylinder 32 in which an injection piston 34 is reversibly guided.

In contrast to the die-casting cylinder described in connection with FIG. 1, the die-casting cylinder 30 of FIG. 2 does not have separate feed and injection chambers, but rather, these two chambers are combined here into a chamber 38 in front of the piston surface 36.

In a first variant of the die-casting cylinder 30, the latter includes a feed opening 40 which is arranged adjacent to the piston surface 36 in a withdrawn dead position of the piston 34. Here, the feed/injection chamber is filled from the side of the piston surface 36 of the piston 34.

In a further variant, the feed opening 40' is arranged at the front end of the feed injection chamber 38 adjacent to a heated channel 42 leading to the molding cavity. In this case, the chamber 38 can be filled for as long as the piston 34 remains in the withdrawn dead position, or, whilst the piston 34 is moving from a frontal dead position (dash—dotted illustration) into the withdrawn dead position (solid line illustration).

In a third variant, the feed opening 40" is attached to the heated channel 42 leading to the molding cavity and is provided adjacent to the front end of the cylinder 32. The possible ways of filling the feed/injection chamber 38 described in connection with the preceding variants also apply in this case too.

Figure 3:
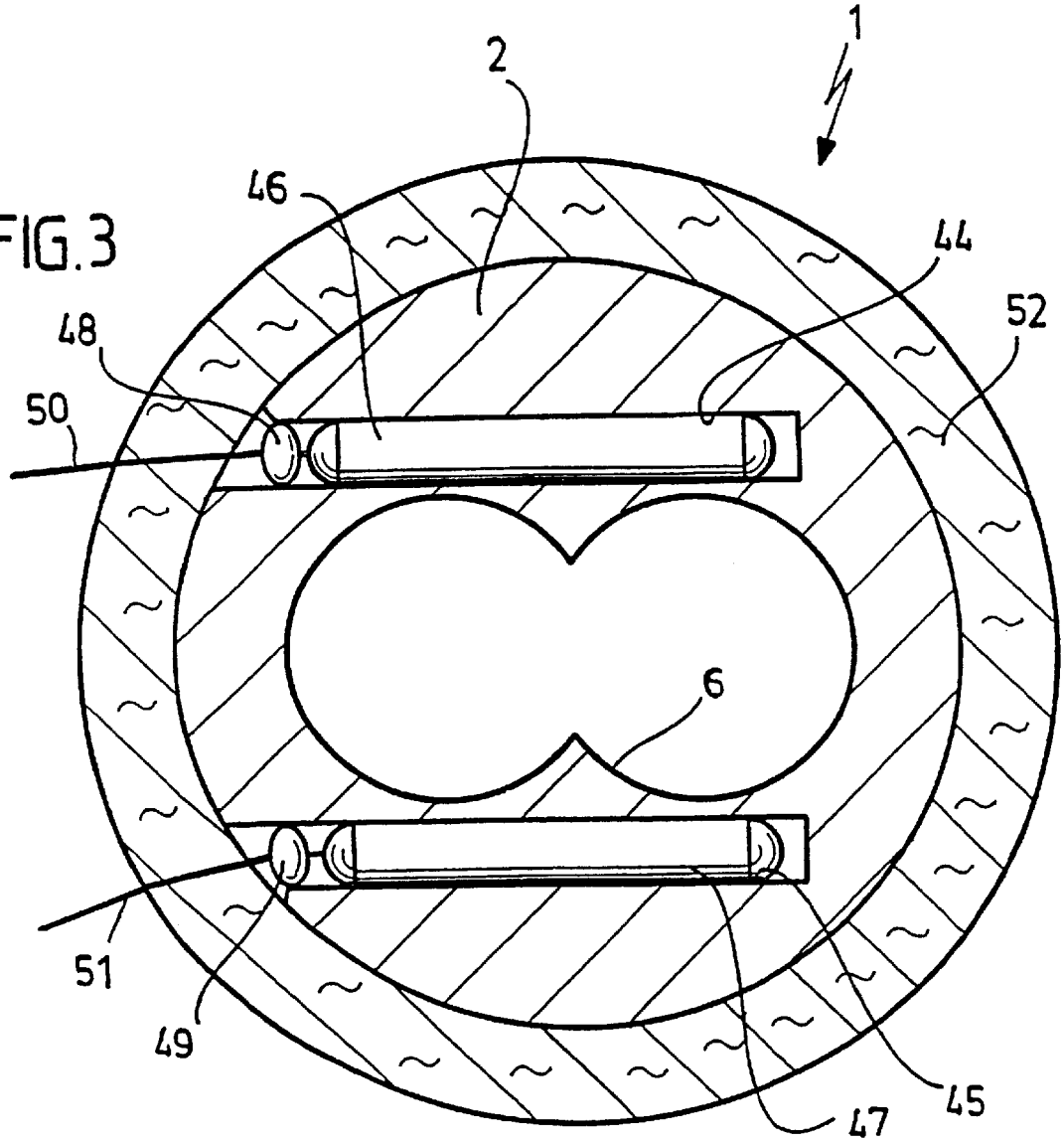
FIG. 3 shows a sectional view through the extruder of FIG. 1 along the line III—III.

FIG. 3 shows a cross-sectional view of the double screw extruder 1 in accordance with the invention along the line 3—3 in FIG. 1. However, in the embodiment shown here, another heating device has been selected instead of the heating collars 13.

For simplicity, the two screws 3 are not illustrated in FIG. 3. They are arranged in the double cylinder hollow chamber 6 which offers enough space for two parallel, adjacently located, mutually meshing screws 3.

Here, the cylinder 2 comprises transverse bores 44, 45 which are transverse to the longitudinal direction thereof and are arranged adjacent to the hollow chamber 6.

Heating cartridges 46, 47 are arranged in the cylindrical bores 44, 45, whereby a very large heat flow to the materials being worked in the extruder 1 can be produced by means of these cartridges due to their proximity to the double cylinder hollow chamber 6.

After the heating cartridges 46, 47 have been inserted into the transverse bores 44, 45, the latter are closed by means of an airtight plug 48, 49 of temperature insensitive material through which it is merely necessary to insert electrical leads 50, 51. An insulating means 52 can be applied externally to the cylinder 1 in a very simple manner, whereby said insulating means has the same thickness over the length of the cylinder 2 and external heating strips do not have to be taken into consideration hereby. The heating cartridges 46, 47 recur over the length of the extruder cylinder 2 and permit individual heating processes to take place over the length of the extruder 1 in the same manner as the heating collars 13.

In an alternative, heating cartridges can be used in the transverse bores which project above the periphery of the extruder cylinder so that the transition region of the heated cartridges is located outside the cylinder and the heating region in the interior of the cylinder. In such a case, it is possible to dispense with the material droplets 48, 49. Dismantling of the arrangement and maintenance thereof are thereby simplified.

Due to the introduction of heat into the hollow chamber of the extruder in the vicinity thereof and the improved insulating possibilities, tie rods for the extruder can be provided externally of the insulating means 52 and these tie rods will experience far lower temperatures then is the case for the usual extruders belonging to the state of the art. These tie rods can thereby be produced from a more economical material since they are subjected to much smaller temperature-induced stresses.

What is claimed as new and desired to be protected by Letters Patent is set forth in the appended claims:

1. Apparatus for manufacturing semi-finished products and molded articles from a metallic material, comprising:

an extruder for producing a flow of the metallic material, and at least one device connected following the extruder for shaping the semi-finished products and the molded articles, wherein the extruder has a screw system comprising at least two meshing screws.

2. The apparatus of claim 1, wherein the screws of the screw system are closely meshing screws.

3. The apparatus of claim 1, wherein the screws of the screw system rotate in the same direction.

4. The apparatus of claim 1, wherein the screws of the screw system rotate in opposite directions.

5. The apparatus of claim 1, and further comprising one or more molding cavities connected subsequent to the extruder and adapted to be loaded with metallic material on a continuous or discontinuous basis.

6. The apparatus of claim 1, wherein the extruder further comprises feed connections for side feeding of additional materials.

7. The apparatus of claim 1, and further comprising one or more die-casting cylinders connected subsequent to the extruder, one or more molding cavities connected subsequent to the die-casting cylinders, one or more multi-way switches and heated channels connected between the extruder and the die-casting cylinders, and between the die-casting cylinders and the molding cavities, respectively, wherein the multi-way switches and heated channels are used for controllably filling the die-casting cylinders with the flow of metallic material and for cyclically filling partial quantities of the metallic material into the molding cavities at high pressure.

8. The apparatus of claim 7, wherein the die-casting cylinder comprises an injection chamber, and the die-casting cylinder is filled through the injection chamber.

9. The apparatus of claim 8, wherein the die-casting cylinder comprises a piston and can be filled for as long as the piston is in a withdrawn dead position.

10. The apparatus of claim 8, wherein the die-casting cylinder comprises a piston and can be filled whilst the piston is moved from a forward dead position into a withdrawn position.

11. The apparatus of claim 7, wherein the die-casting cylinder can be filled via the channel disposed between a die-casting cylinder and a molding cavity.

12. The apparatus of claim 1, and further comprising one or more die-casting molding cavities, one or more die-casting cylinders connected subsequent to the extruder, each die-casting cylinder having a cylinder chamber and an injection piston in form of a differential piston which is disposed in the cylinder chamber and subdivides the cylinder chamber into an injection chamber and a feed chamber, and a fluidic connection disposed between the feed chamber and the injection chamber, said fluidic connection incorporating a reverse flow preventing means which blocks a fluid flow from the injection chamber to the feed chamber while providing continuity from the feed chamber to the injection chamber, wherein the feed chamber is in communication with an output port of the extruder via a heated channel and the injection chamber is in communication with one or more of the die-casting molding cavities, and wherein a surface area of the differential piston bounding the injection chamber is greater than a surface area of the differential piston bounding the feed chamber.

13. The apparatus of claim 12, wherein the surface area of the differential piston bounding the feed chamber has an annular cross-section.

14. The apparatus of claim 12, wherein a controllable shut-off nozzle is arranged in the region between the die-casting molding cavity and the injection chamber.

15. The apparatus of claim 1, wherein the extruder comprises a cylinder wall and further includes heating cartridges arranged in transverse bores in the cylinder wall for heating the extruder.

16. The apparatus of claim 15, wherein the extruder comprises an insulating layer arranged around the cylinder wall of the extruder and tie rods arranged externally of the insulating layer.

* * * * *

UNITED STATES PATENT AND TRADEMARK OFFICE

CERTIFICATE OF CORRECTION

PATENT NO. : 6,648,057 B2
DATED : November 18, 2003
INVENTOR(S) : Andreas Dworog et al.

It is certified that error appears in the above-identified patent and that said Letters Patent is hereby corrected as shown below:

Title page,
Item [30], Foreign Application Priority Data, delete "Feb. 21, 2000" insert
-- Feb. 19, 1999 --

Signed and Sealed this

Sixteenth Day of March, 2004

JON W. DUDAS
*Acting Director of the United States Patent and Trademark Office*